US006413703B1

(12) United States Patent
Tappe et al.

(10) Patent No.: US 6,413,703 B1
(45) Date of Patent: Jul. 2, 2002

(54) COLOR PHOTOGRAPHIC DEVELOPER CONCENTRATE

(75) Inventors: Gustav Tappe; Wolfgang körner, both of Leverkusen (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/659,213

(22) Filed: Sep. 11, 2000

(30) Foreign Application Priority Data

Sep. 13, 1999 (DE) ..... 199 43 660
Feb. 8, 2000 (DE) ..... 100 05 498

(51) Int. Cl.[7] ..... G03C 7/413
(52) U.S. Cl. ..... 430/466
(58) Field of Search ..... 430/466

(56) References Cited

U.S. PATENT DOCUMENTS 5,891,609 A * 4/1999 Papai ..... 430/466
5,914,221 A 6/1999 Kim et al. ..... 430/466
6,017,687 A * 1/2000 Darmon et al. ..... 430/466
6,077,651 A * 6/2000 Darmon et al. ..... 430/466

FOREIGN PATENT DOCUMENTS

JP 10-333302 12/1998

* cited by examiner

*Primary Examiner*—Hoa Van Le
(74) *Attorney, Agent, or Firm*—Connolly Bove Lodge & Hutz LLP

(57) ABSTRACT

A one-part colour developer concentrate which contains at least one colour developer substance, at least one antioxidant, at least one water softener, a buffer system, alkali, which concentrate contains at most 0.1 mol of sulfate ions/L, is usable for a wide range of regeneration rates and exhibits no precipitation at down to −7° C. if it is prepared as a multi-phase concentrate using organic, water-soluble solvents.

10 Claims, No Drawings

COLOR PHOTOGRAPHIC DEVELOPER CONCENTRATE

The developer solution for developing colour photographic materials, in particular for developing colour photographic paper, is prepared from or, in the case of continuous operation, replenished with concentrates which contain the necessary constituents.

It is conventional to provide three different concentrates, as certain constituents of the developer bath are not mutually compatible on extended storage. Thus, for example, one concentrate contains the antioxidant, an auxiliary solvent and an optical brightener, a second concentrate contains the colour developer substance, for example 4-(N-ethyl-N-2-methylsulfonylaminoethyl)-2-methylphenylenediamine sesquisulfate (CD-3) or 4-(N-ethyl-N-2-hydroxyethyl)-2-methylphenylenediamine sulfate (CD-4) and a third concentrate contains the buffer substance, alkali and a water softener.

There has been no lack of attempts to develop stable, one-part colour developer concentrates as handling errors during preparation or replenishing of a developer solution may consequently be avoided.

The following one-part concentrates are currently commercially available, a) Monoline® RA-4 CD-R from Tetenal, a two-phase concentrate with a solid, undissolved phase deposited at the bottom and b) TriPhase® RA-4 CD-R from Trebla, a three-phase concentrate with undissolved constituents in the middle phase (c.f. also U.S. Pat. No. 5,891,609).

In both cases, the presence of undissolved constituents is disadvantageous for the purposes of handling the concentrate. Especially when preparing the regenerating solution, problems may occur because the undissolved constituents dissolve only poorly. It is also disadvantageous to use one-part concentrates which, while initially containing no undissolved constituents, have a tendency at low temperatures, for example during storage or transport at down to −7° C., to form precipitates which are insoluble or only sparingly soluble when the temperature is raised.

A one-part, one-phase concentrate known as Prime SP, which has a very high solvent content and is suitable only for certain regeneration rates, is also commercially available from Kodak.

JP published patent application 10 333 302 discloses a one-part colour developer concentrate which contains the least possible sulfate and is stable and in one phase due to addition of triethanolamine and establishing a pH of 12.8 or higher. It is only suitable for low regeneration rates of for example 70 mL/m$^2$, as are used in developing machines operating at full capacity utilisation.

EP 980 024 (published on 16.02.2000) and U.S. Pat. No. 6,017,687 (published on 25.01.2000) describe homogenous, one-part, low-sulfate colour developer concentrates.

U.S. Pat. No. 5,914,221 describes a one-part colour developer concentrate comprising a concentrated suspension of a liquid phase and a non-homogeneous solid phase.

However, if higher regeneration rates of approx. 120 mL/m$^2$ or even 160 mL/m$^2$ are to be used, i.e. if the concentrates are to be more highly diluted, as is the case in developing machines operating at lower capacity utilisation or susceptible to oxidation and/or evaporation or for professional use, it is not possible to use such alkaline concentrates. However, if the pH value in this concentrate is reduced, the colour developer substance begins to precipitate.

The object of the invention was to provide a one-part concentrate for a colour developer which contains no undissolved constituents, which, when cooled to temperatures of down to −7° C., does not form precipitates which are insoluble or only sparingly soluble when the temperature is raised and from which regeneration solutions may be prepared for any desired regeneration rate.

This object is achieved by producing a multi-phase, in particular two-phase concentrate which, apart from the conventional chemicals required for developing a colour photographic material, contains at most 0.1 mol of sulfate ions/L. The colour developer substance is, for example, added to the concentrate not as the sulfate, as is usual with CD-3 or CD-4, but instead as a phosphate, p-toluenesulfonate, chloride or as the free base.

CD-3 (sesquisulfate) or CD-4 (sulfate) may also be used and the sulfate ions removed by precipitation with metal ions and filtration.

In a preferred embodiment, the concentrate furthermore contains a minimum quantity of one or more water-soluble organic solvents.

In a preferred embodiment, the organic solvent contains a mixture of polyethylene glycols of differing molecular weights from monoethylene glycol up to polyethylene glycol having an average molecular weight of 20000, for example a mixture of diethylene glycol, polyethylene glycol having an average molecular weight of 400 and polyethylene glycol having an average molecular weight of 1500. The average molecular weights are weight averages.

In this manner, it is possible to establish optimum conditions for non-precipitating, one-part developer concentrates.

The polyethylene glycol mixture in particular constitutes at least 90 vol. % of the organic solvent.

A concentrate for the purposes of the invention is an aqueous preparation, 1 part by volume of which is diluted with 1 to 39 parts by volume of water in order to produce a ready-to-use solution; the concentrate contains at least 50 mmol, preferably 70 to 700 mmol of colour developer substance/L.

The present invention accordingly provides a one-part colour developer concentrate which does not precipitate during storage and contains at least one colour developer substance, at least one antioxidant, at least one water softener, a buffer system, alkali and contains at most 0.1, preferably at most 0.05 and particularly preferably at most 0.02 mol of sulfate ions/L, characterised in that the concentrate is a multi-phase, in particular two-phase, concentrate.

Water-soluble organic solvents which may be considered are those from the range of glycols, polyglycols, alkanolamines, aliphatic and heterocyclic carbonamides, aliphatic and cyclic monoalcohols, wherein 50 to 95 wt. %, preferably 60 to 90 wt. % of the total of water and water-soluble solvent is water.

Suitable water-soluble solvents are, for example, carboxylic acid amide and urea derivatives such as dimethylformamide, methylacetamide, dimethylacetamide, N,N'-dimethylurea, tetramethylurea, methanesulfonamide, dimethylethyleneurea, N-acetylglycine, N-valeramide, isovaleramide, N-butyramide, N,N-dimethylbutyr-amide, N-(2-hydroxyphenyl)acetamide, N-(2-methoxyphenyl) acetamide, 2-pyrrolidinone, ε-caprolactam, acetanilide, benzamide, toluenesulfonamide, phthalimide;

- aliphatic and cyclic alcohols, for example isopropanol, tert.-butyl alcohol, cyclohexanol, cyclohexanemethanol, 1,4-cyclohexanedimethanol;
- aliphatic and cyclic polyalcohols, for example glycols, polyglycols, polywaxes, trimethyl-1,6-hexanediol, glycerol, 1,1,1-trimethylolpropane, pentaerythritol, sorbitol;
- aliphatic and cyclic ketones, for example acetone, ethyl methyl ketone, diethyl ketone, tert.-butyl methyl ketone, diisobutyl ketone, acetylacetone, acetonylacetone, cyclopentanone, acetophenol;
- aliphatic and cyclic carboxylic acid esters, for example trimethoxymethane, methyl acetate, allyl acetate, ethylene glycol monomethyl ether acetate, ethylene glycol diacetate, glycerol 1-acetate, glycerol diacetate, methylcyclohexyl acetate, methyl salicylate, phenyl salicylate;

aliphatic and cyclic phosphonic acid esters, for example methylphosphonic acid dimethyl ester, allylphosphonic acid diethyl ester;

aliphatic and cyclic oxyalcohols, for example 4-hydroxy-4-methyl-2-pentanone, salicylaldehyde;

aliphatic and cyclic aldehydes, for example acetaldehyde, propanal, trimethylacetaldehyde, crotonaldehyde, glutaraldehyde, 1,2,5,6-tetrahydrobenzaldehyde, benzaldehyde, benzenepropane, terephthalaldehyde;

aliphatic and cyclic oximes, for example butanone oxime, cyclohexanone oxime;

aliphatic and cyclic amines (primary, secondary or tertiary), for example ethylamine, diethylamine, triethylamine, dipropylamine, pyrrolidine, morpholine, 2-aminopyrimidine;

aliphatic and cyclic polyamines (primary, secondary or tertiary), for example ethylenedi amine, 1-amino-2-diethylaminoethane, methyl-bis(2-methylaminoethyl)-amine, permethyldiethylenetriamine, 1,4-cyclohexanediamine, 1,4-benzenediamine;

aliphatic and cyclic hydroxyamines, for example ethanolamine, 2-methylethylamine, 2-methylaminoethanol, 2-(dimethylamino)ethanol, 2-(2-dimethylaminoethoxy)-ethanol, diethanolamine, N-methyldiethanolamine, triethanolamine, 2-(2-aminoethylamino)ethanol, triisopropanolamine, 2-amino-2-hydroxymethyl-1,3-propanediol, 1-piperidineethanol, 2-aminophenol, barbituric acid, 2-(4-aminophenoxy)-ethanol, 5-amino-1-naphthol.

Processing conditions, suitable colour developer substances, suitable buffer substances, suitable water softeners, suitable optical brighteners, auxiliary developers, wetting agents, development accelerators and antifogging agents are described on pages 102 to 107 of Research Disclosure 37 038 (February 1995).

Multi-phase means that the concentrate contains two or more liquid phases, but no precipitation. The liquid phases are, for example, an aqueous and an organic phase.

Suitable antioxidants are compounds of the formulae (I), (II) and (III).

(I)

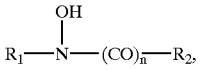

in which $R_1$ means optionally substituted alkyl, $R_2$ means optionally substituted alkyl or optionally substituted aryl and n means 0 or 1 preferably those in which at least one of the residues $R_1$ and $R_2$ contains at least one—OH, —COOH or —$SO_3H$ group;

(II)

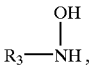

in which $R_3$ means an optionally substituted alkyl or optionally substituted acyl group;

(III)

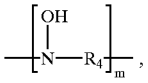

in which $R_4$ means an alkylene group optionally interrupted by O atoms and m means a number of at least 2.

The alkyl groups $R_1$, $R_2$, $R_3$, the alkylene group $R_4$ and the aryl group $R_2$ may bear further substituents in addition to the stated substitution.

Examples of suitable antioxidants are (0-1)

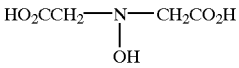

(0-2)

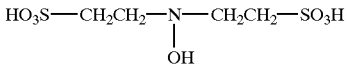

(0-3)

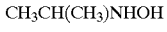

(0-4)

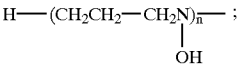

n = 20

(0-5)

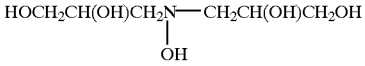

(0-6)

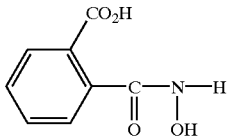

(0-7)

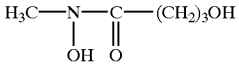

(0-8)

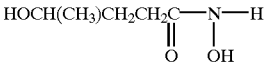

(0-9)

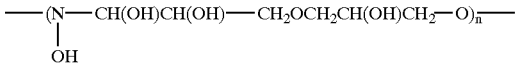

(n = 10)

(0-10)

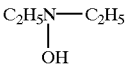

(0-11)

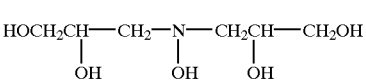

The phase boundary disappears on dilution of the concentrate with water to produce the ready-to-use colour developer or regenerator; the ready-to-use developer is one-phase.

EXAMPLES

Example 1

(Comparison)

The constituents listed below of a colour developer regenerator are combined in a concentrate (the ready-to-use regenerator is produced from the concentrate by dilution with water):

One-part, one-phase developer concentrate:

| | |
|---|---|
| Diethylhydroxylamine, 85 wt. % aqueous solution (DEHX soln.) | 35 mL |
| CD3 | 50 g |
| Diethylene glycol | 30 mL |
| Optical brightener W1 | 2 g |
| Ethylenediaminetetraacetic acid (EDTA) | 10 g |
| Potassium carbonate | 60 g |
| adjust to pH 13.5 with KOH and make up to 1 liter with water. | |

Constituents precipitate out of the concentrate at room temperatures.

Example 2

(Comparison)

One-part, one-phase developer concentrate:

| | |
|---|---|
| Antioxidant O-2 | 35 g |
| CD3 | 50 g |
| Diethylene glycol | 30 mL |
| Optical brightener W1 | 2 g |
| EDTA | 10 g |
| Potassium carbonate | 60 g |
| adjust to pH 13.5 with KOH and make up to 1 liter with water. | |

Constituents precipitate out of the colour developer concentrate at room temperature.

Example 3

(Comparison)

One-part, one-phase developer concentrate:

| | |
|---|---|
| DEHX soln. | 35 mL |
| CD3 | 50 g |
| Diethylene glycol | 30 mL |
| Optical brightener | 2 g |
| polymaleic acidanhydride, 50% by weight aq. solution | 15 mL |
| Sodium carbonate | 60 g |
| adjust to pH 13.5 with NaOH and make up to 1 liter with water. | |

Constituents precipitate out of the concentrate at −7° C.

Example 4

(Comparison)

One-part, one-phase developer concentrate:

| | |
|---|---|
| Antioxidant O-2 | 35 g |
| CD3 | 50 g |
| Diethylene glycol | 30 mL |
| Optical brightener | 2 g |
| EDTA | 10 g |
| Sodium carbonate | 60 g |
| adjust to pH 13.5 with NaOH and make up to 1 liter with water. | |

Constituents precipitate out of the concentrate at −7° C.

Example 5

(Comparison)

One-part, multi-phase developer concentrate:

| | |
|---|---|
| DEHX solution | 60 mL |
| CD-3 | 70 g |
| Caprolactam | 100 g |
| Triethanolamine | 80 mL |
| Optical brightener | 10 g |
| EDTA | 30 g |
| Potassium carbonate | 165 g |
| KOH | 42 g |
| adjust to pH 11.2 with KOH and make up to 1 L with water. | |

Constituents precipitate out of the concentrate at room temperature.

Example 6

(Comparison)

One-part, multi-phase developer concentrate:

| | |
|---|---|
| DEHX solution | 60 mL |
| CD-3 | 70 g |
| Caprolactam | 100 g |
| Triethanolamine | 80 mL |
| Optical brightener | 10 g |
| EDTA | 30 g |
| Sodium carbonate | 130 g |
| NaOH | 30 g |
| adjust to pH 11.2 with NaOH and make up to 1 L with water. | |

Constituents precipitate out of the concentrate at −7° C.

Example 7

(According to the Invention)

One-part, multi-phase developer concentrate:

| | |
|---|---|
| DEHX solution | 60 mL |
| CD-3 phosphate | 70 g |
| Caprolactam | 100 g |
| Triethanolamine | 80 mL |
| Optical brightener | 10 g |
| EDTA | 30 g |
| Potassium carbonate | 165 g |
| KOH | 42 g |
| adjust to pH 11.2 with KOH and make up to 1 L with water. | |

No precipitation at room temperature nor on cooling to −7° C.

Example 8

(According to the Invention)

One-part, multi-phase developer concentrate:

| | |
|---|---|
| Antioxidant O-2 | 60 g |
| CD-3 phosphate | 70 g |
| Caprolactam | 100 g |
| Triethanolamine | 80 mL |
| Optical brightener | 10 g |
| Diethylene triamine pentaacetic acid | 40 g |

-continued

| | |
|---|---|
| Potassium carbonate | 165 g |
| KOH | 42 g |
| adjust to pH 11.2 with KOH and make up to 1 L with water. | |

No precipitation at room temperature nor on cooling to −7° C.

Example 9
(According to the Invention)

| One-part, multi-phase developer concentrate: | |
|---|---|
| Antioxidant agent O-2 | 60 g |
| CD-3 base | 43.5 g |
| Caprolactam | 100 g |
| Triethanolamine | 80 mL |
| Optical brightener | 10 g |
| EDTA | 30 g |
| Potassium carbonate | 165 g |
| KOH | 25 g |
| adjust to pH 11.2 with KOH and make up to 1 L with water. | |

No precipitation at room temperature nor on cooling to −7° C.

Example 10
(According to the Invention)

| One-part, multi-phase developer concentrate: | |
|---|---|
| DEHX solution | 70 mL |
| CD-3 | 66 g |
| Diethylene glycol | 100 mL |
| Polyethylene glycol, $\overline{M}$ w 400 | 50 mL |
| Polyethylene glycol, $\overline{M}$ w 6000 | 50 g |
| Optical brightener | 10 g |
| EDTA | 30 g |
| Potassium carbonate | 240 g |
| KOH | 33.7 g |
| adjust to pH 11.2 with KOH and make up to 1 L with water. | |

CD-3 is first mixed with KOH and DEHX solution in water. The $K_2SO_4$ which precipitates during this operation is filtered out. The remaining components are then added.

Example 11

A colour photographic recording material was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

Layer Structure 1

1st layer (substrate layer)
- 0.1 g of gelatine

2nd layer (blue-sensitive layer):
- Blue-sensitive silver halide emulsion (99.5 mol % AgCl, 0.5 mol % AgBr, average grain diameter 0.9 μm) prepared from 0.50 g of gelatine
- 0.42 g of yellow coupler GB-1
- 0.18 g of yellow coupler GB-2
- 0.50 g of tricresyl phosphate (TCP)
- 0.10 g of stabiliser ST-1

3rd layer (interlayer)
- 1.1 g of gelatine
- 0.06 g of scavenger SC-1
- 0.06 g of scavenger SC-2
- 0.12 g of TCP 4th layer (green-sensitive layer):
- Green-sensitive silver halide emulsion (99.5 mol % AgCl, 0.5 mol % AgBr, average grain diameter 0.47 μm) prepared from
- 0.40 g of $AgNO_3$
- 0.77 g of gelatine
- 0.21 g of magenta coupler PP-1
- 0.15 g of magenta coupler PP-2
- 0.05 g of magenta coupler PP-3
- 0.06 g of colour stabiliser ST-2
- 0.12 g of scavenger SC2
- 0.23 g of dibutyl phthalate 5th layer (UV protective layer):
- 1.15 g of gelatine
- 0.03 g of scavenger SC-1
- 0.03 g of scavenger SC-2
- 0.5 g of UV absorber UV-1
- 0.10 g of UV absorber UV-2
- 0.35 g of TCP 6th layer (red-sensitive layer)
- Red-sensitive silver halide emulsion (99.5 mol % AgCl, 0.5 mol % AgBr, average grain diameter 0.5 μm) prepared from
- 0.30 g of $AgNO_3$ with
- 1.0 g of gelatine
- 0.40 g of cyan coupler BG-1
- 0.05 g of cyan coupler BG-2
- 0.46 g of TCP 7th layer (UV protective layer):
- 0.35 g of gelatine
- 0.15 g of UV-1
- 0.03 g of WV-2
- 0.09 g of TCP 8th layer (protective layer):
- 0.9 g of gelatine
- 0.3 g of hardener HM
- 0.05 g of optical brightener W-1
- 0.07 g of vinylpyrrolidone
- 1.2 mg of silicone oil
- 2.5 mg of polymethyl methacrylate microspheres with an average particle diameter of 0.8 μm GB-1
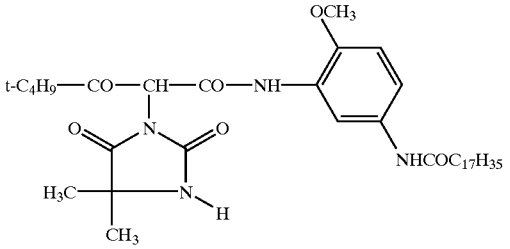
GB-2
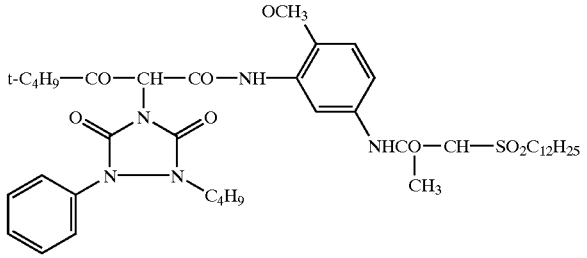
ST-1
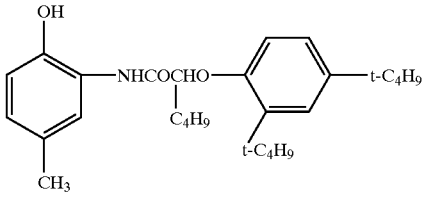
SC-1
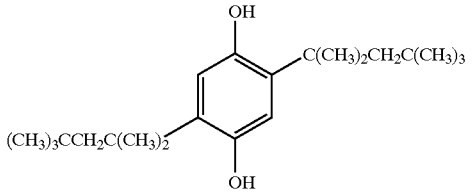
SC-2
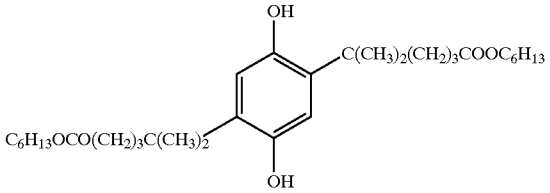
PP-1
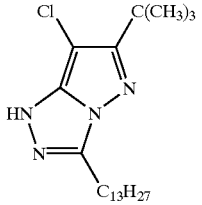
PP-2
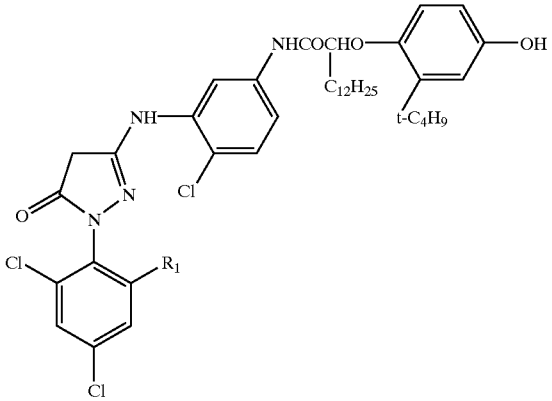
PP-3
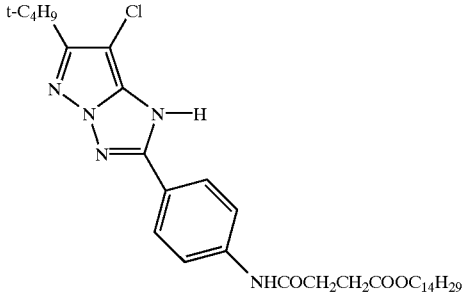
ST-2
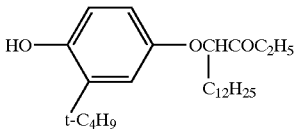
UV-1
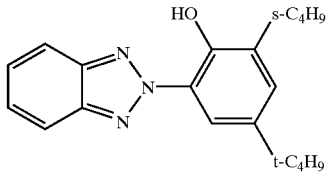
UV-2
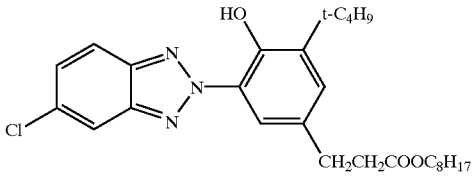
BG-1
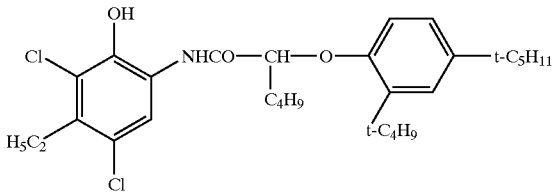

-continued

BG-2

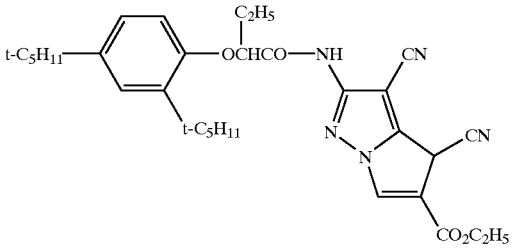

W-1

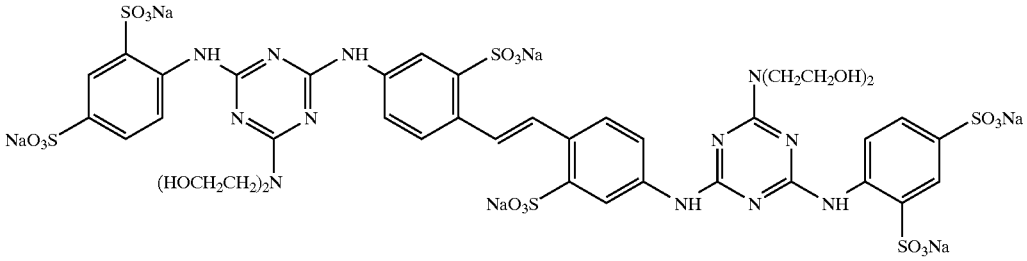

HM

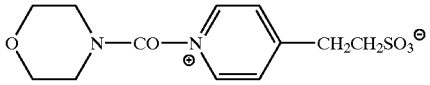

The colour photographic recording material is exposed and processed under the following conditions:

| Step | Time | Temperature |
|---|---|---|
| Development | 27 sec | 39° C. |
| Bleach/fixing | 27 sec | 35° C. |
| Stabilisation | 54 sec | 33° C. |

The colour developer used was, on the one hand, ready-to-use developer prepared from the concentrates according to Examples 7, 8, 9 and 10 and, on the other, developer prepared from three separate concentrates according to the prior art, wherein both ready-to-use developers were of identical composition with the exception of the sulfate content.

| Bleach/fixing bath | |
|---|---|
| Ammonium thiosulfate solution, 58 wt. % | 100 mL |
| Sodium disulfite | 5 g |
| Ammonium-iron EDTA, 48 wt. % | 100 mL |

make up with water to 1000 mL, adjust pH value to 6.0 with ammonia or acetic acid.

| Stabilising bath | |
|---|---|
| Water | 900 mL |
| Sodium sulfite | 2 g |
| Hydroxyethanediphosphonic acid disodium salt | 4 g |
| Sodium benzoate | 0.5 g |

make up with water to 1000 mL, adjust pH value to 5 with acetic acid.

Drying

The resultant images exhibited no significant differences with regard to their sensitometric properties.

Example 12

(Comparison)

| One-part, one-phase developer concentrate: | |
|---|---|
| Potassium disulfite | 40 g |
| CD-4 | 60 g |
| Hydroxylammonium sulfate | 30 g |
| Potassium carbonate | 40 g |
| EDTA | 20 g |
| Potassium bromide | 5 g |
| adjust to pH 10.6 with potassium hydroxide solution and make up to 1 L with water. | |

Constituents precipitate out of the colour developer concentrate at room temperature.

Example 13

(Comparison)

| One-part, one-phase developer concentrate: | |
|---|---|
| Antioxidant O-2 | 75 g |
| CD-4 | 60 g |
| Potassium carbonate | 40 g |
| EDTA | 20 g |
| Potassium bromide | 5 g |
| adjust to pH 10.6 with potassium hydroxide solution and make up to 1 L with water. | |

Constituents precipitate out of the colour developer concentrate at room temperature.

Example 14

(Comparison)

| One-part, multi-phase developer concentrate: | |
|---|---|
| Antioxidant O-2 | 75 g |
| CD-4 | 60 g |
| Caprolactam | 160 g |
| Potassium carbonate | 40 g |
| EDTA | 20 g |
| Potassium bromide | 5 g |
| adjust to pH 10.6 with potassium hydroxide solution and make up to 1 L with water. | |

Constituents precipitate out of the colour developer concentrate at room temperature.

Example 15

(Comparison)

| One-part, multi-phase developer concentrate: | |
|---|---|
| DEHX solution | 60 mL |
| CD-4 | 60 g |
| Caprolactam | 160 g |
| Potassium carbonate | 40 g |
| EDTA | 20 g |
| Potassium bromide | 5 g |
| adjust to pH 10.6 with potassium hydroxide solution and make up to 1 L with water. | |

Constituents precipitate out of the colour developer concentrate at room temperature.

Example 16

(According to the Invention)

| One-part, multi-phase developer concentrate: | |
|---|---|
| Antioxidant O-2 | 75 g |
| CD-4 phosphate | 54 g |
| Caprolactam | 160 g |
| Potassium carbonate | 40 g |
| EDTA | 20 g |
| Potassium bromide | 5 g |
| adjust to pH 10.6 with potassium hydroxide solution and make up to 1 L with water. | |

No precipitation at room temperature nor on cooling to −7° C.

Example 17

(According to the Invention)

| One-part, multi-phase developer concentrate: | |
|---|---|
| DEHX solution | 60 mL |
| CD-4 phosphate | 54 g |
| Caprolactam | 160 g |
| Potassium carbonate | 40 g |
| EDTA | 20 g |
| Potassium bromide | 5 g |
| adjust to pH 10.6 with potassium hydroxide solution and make up to 1 L with water. | |

No precipitation at room temperature nor on cooling to −7° C.

Example 18

(According to the Invention)

| One-part, multi-phase developer concentrate: | |
|---|---|
| DEHX solution | 60 mL |
| CD-4 base | 41 g |
| Caprolactam | 160 g |
| Potassium carbonate | 40 g |
| EDTA | 20 g |
| Potassium bromide | 5 g |
| adjust to pH 10.6 with potassium hydroxide solution and make up to 1 L with water | |

No precipitation at room temperature nor on cooling to −7° C.

Example 19

(According to the Invention)

| One-part, one-phase developer concentrate: | |
|---|---|
| Antioxidant O-2 | 75 g |
| CD-4 base | 41 g |
| Polyglycol P 400 | 250 mL |
| Potassium carbonate | 40 g |
| EDTA | 20 g |
| Potassium bromide | 5 g |
| adjust to pH 10.6 with potassium hydroxide solution and make up to 1 L with water. | |

No precipitation at room temperature nor on cooling to −7° C.

The developers from Examples 16 to 19 intended for color negative film are also suitable for rapid processing with a development time of 60 seconds.

Example 20

A colour photographic recording material for colour negative development was produced by applying the following layers in the stated sequence onto a layer support of transparent cellulose triacetate. Quantities are stated in each case per 1 $m^2$. The silver halide application rate is stated as the corresponding quantities of $AgNO_3$; the silver halides are stabilised with 1 mmol of 4-hydroxy-6-methyl-1,3,3a,7-tetraazaindene per mol of $AgNO_3$. All emulsions are optimally chemically ripened with sulfur, selenium and gold. AV means Aspect Ratio.

| 1st layer | (anti-halo layer) |
|---|---|
| 0.3 g | of black colloidal silver |
| 1.2 g | of gelatine |
| 0.3 g | of UV absorber UV-2 |
| 0.2 g | of DOP (developer oxidation product) scavenger SC-3 |
| 0.02 g | of tricresyl phosphate (TCP) |
| **2nd layer** | **(low-sensitivity red-sensitive layer)** |
| 0.7 g | of $AgNO_3$ of a spectrally red-sensitised AgBrI emulsion, 4 mol % iodide, average grain diameter 0.42 μm, AV 5, volume distribution coefficient 25% |
| 1 g | of gelatine |
| 0.35 g | of colourless coupler C-1 |
| 0.05 g | of coloured coupler RC-1 |
| 0.03 g | of coloured coupler YC-1 |
| 0.36 g | of TCP |

-continued

| | |
|---|---|
| 3rd layer | (medium-sensitivity red-sensitive layer) |
| 0.8 g | of $AgNO_3$ of a spectrally red-sensitised AgBrI emulsion, 5 mol % iodide, average grain diameter 0.53 μm, AV 6, volume distribution coefficient 23% |
| 0.6 g | of gelatine |
| 0.15 g | of colourless coupler C-2 |
| 0.03 g | of coloured coupler RC-1 |
| 0.02 g | of DIR coupler D-1 |
| 0.18 g | of TCP |
| 4th layer | (high-sensitivity red-sensitive layer) |
| 1 g | of $AgNO_3$ of a spectrally red-sensitised AgBrI emulsion, 6 mol % iodide, average grain diameter 0.85 μm, AV 9, volume distribution coefficient 20% |
| 1 g | of gelatine |
| 0.1 g | of colourless coupler C-2 |
| 0.005 g | of DIR coupler D-2 |
| 0.11 g | of TCP |
| 5th layer | (interlayer) |
| 0.8 g | of gelatine |
| 0.07 g | of DOP scavenger SC-2 |
| 0.06 g | of aurintricarboxylic acid aluminium salt |
| 6th layer | (low-sensitivity green-sensitive layer) |
| 0.7 g | of $AgNO_3$ of a spectrally green-sensitised AgBrI emulsion, 4 mol % iodide, average grain diameter 0.35 μm, AV 5, volume distribution coefficient 20% |
| 0.8 g | of gelatine |
| 0.22 g | of colourless coupler M-1 |
| 0.065 g | of coloured coupler YM-1 |
| 0.02 g | of DIR coupler D-3 |
| 0.2 g | of TCP |
| 7th layer | (medium-sensitivity green-sensitive layer) |
| 0.9 g | of $AgNO_3$ of a spectrally green-sensitised AgBrI emulsion, 4 mol % iodide, average grain diameter 0.50 μm, AV 7, volume distribution coefficient 24% |
| 1 g | of gelatine |
| 0.16 g | of colourless coupler M-1 |
| 0.04 g | of coloured coupler YM-1 |
| 0.015 g | of DIR coupler D-4 |
| 0.14 g | of TCP |
| 8th layer | (high-sensitivity green-sensitive layer) |
| 0.6 g | of $AgNO_3$ of a spectrally green-sensitised AgBrI emulsion, 6 mol % iodide, average grain diameter 0.70 μm, AV 10, volume distribution coefficient 20% |
| 1.1 g | of gelatine |
| 0.05 g | of colourless coupler M-2 |

-continued

| | |
|---|---|
| 0.01 g | of coloured coupler YM-2 |
| 0.02 g | of DIR coupler D-5 |
| 0.08 g | of TCP |
| 9th layer | (yellow filter layer) |
| 0.09 g | of yellow dye GF-1 |
| 1 g | of gelatine |
| 0.08 g | of DOP scavenger SC-2 |
| 0.26 g | of TCP |
| 10th layer | (low-sensitivity blue-sensitive layer) |
| 0.3 g | of $AgNO_3$ of a spectrally blue-sensitised AgBrI emulsion, 6 mol % iodide, average grain diameter 0.44 μm, AV 4, volume distribution coefficient 20% |
| 0.5 g | of $AgNO_3$ of a spectrally blue-sensitised AgBrI emulsion, 6 mol % iodide, average grain diameter 0.50 μmm, AV 5, volume distribution coefficient 18% |
| 1.9 g | of gelatine |
| 1.1 g | of colourless coupler Y-1 |
| 0.037 g | of DIR coupler D-6 |
| 0.6 g | of TCP |
| 11th layer | (high-sensitivity blue-sensitive layer) |
| 0.6 g | of $AgNO_3$ of a spectrally blue-sensitised AgBrI emulsion, 7 mol % iodide, average grain diameter 0.95 μm |
| 1.2 g | of gelatine |
| 0.1 g | of colourless coupler Y-1 |
| 0.006 g | of DIR coupler D-7 |
| 0.11 g | of TCP |
| 12th layer | (micrate layer) |
| 0.1 g | of $AgNO_3$ of a micrate AgBrI emulsion, 0.5 mol % iodide, average grain diameter 0.06 μm |
| 1 g | of gelatine |
| 0.004 mg | of $K_2[PdCl_4]$ |
| 0.4 g | of UV absorber UV-3 |
| 0.3 g | of TCP |
| 13th layer | (protective and hardening layer) |
| 0.25 g | of gelatine |
| 0.75 g | of hardener HM |

Once hardened, the overall layer structure had a swelling factor of ≦3.5.

Substances used in Example 20, where not described in Example 11:

UV-3

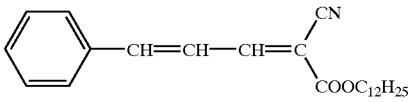

C-1

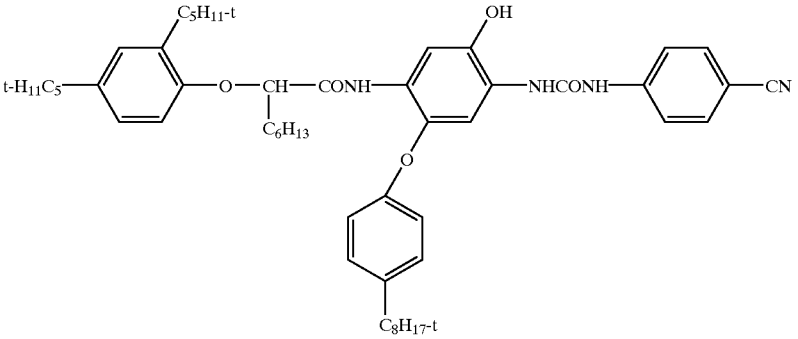

-continued
C-2
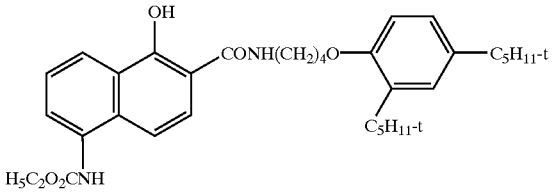
RC-1
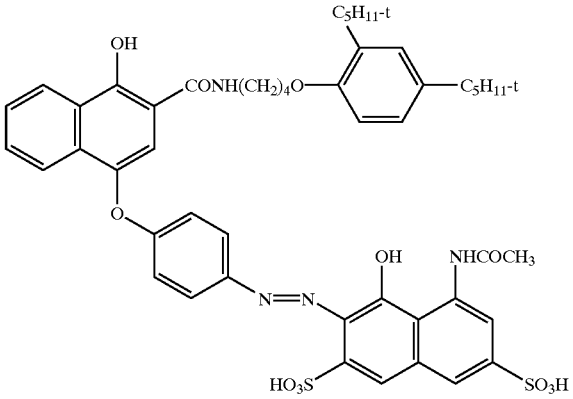
YC-1
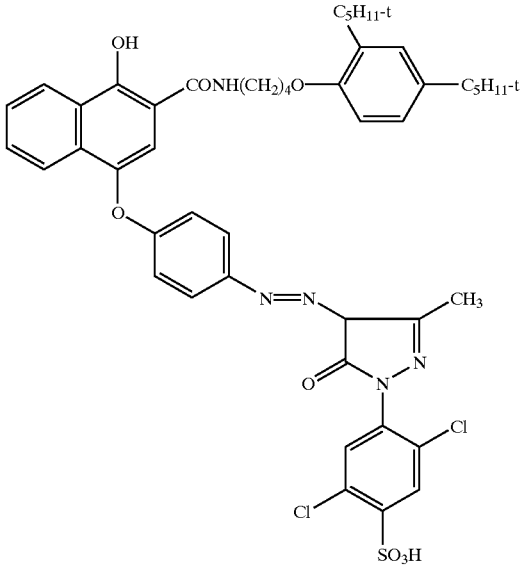
M-1
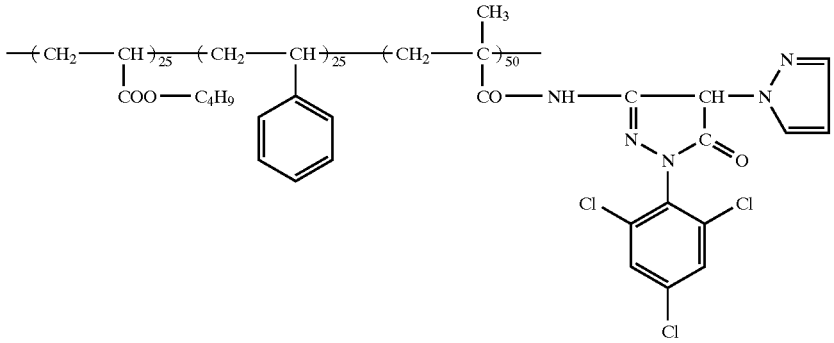

-continued
M-2
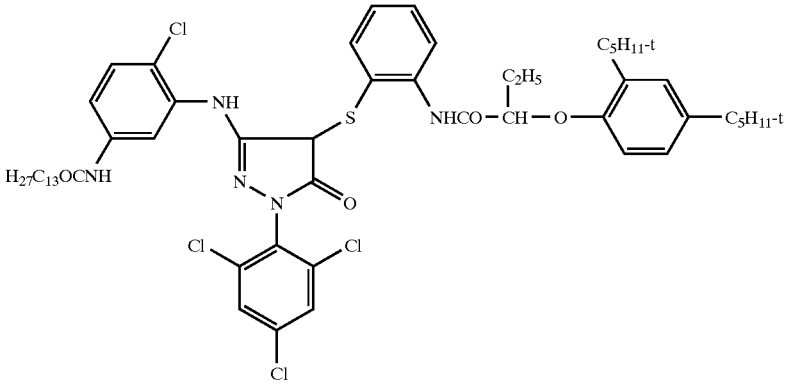
YM-1
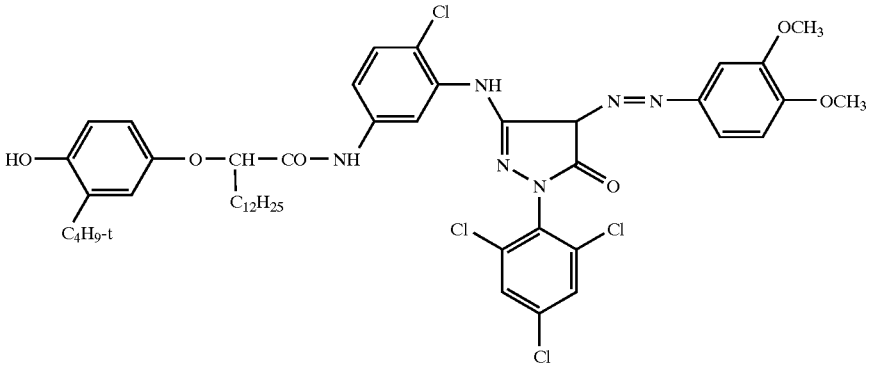
YM-2
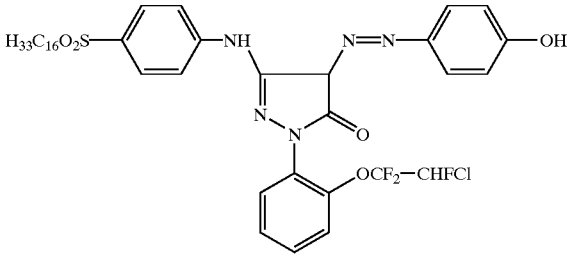
Y-1
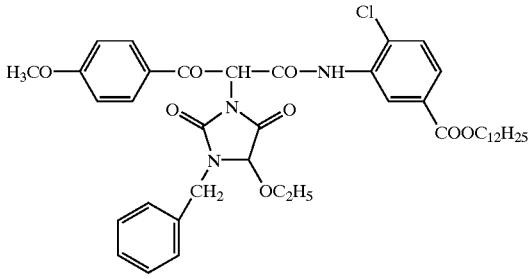
D-1
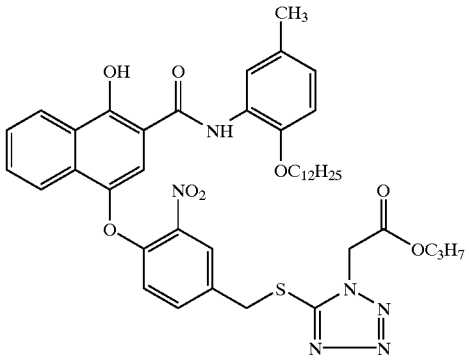
D-2
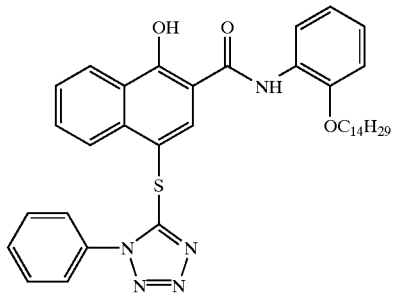

-continued

D-3

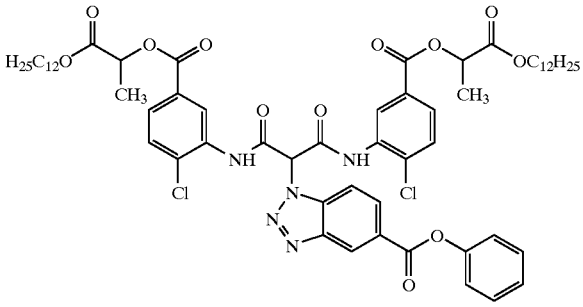

D-4

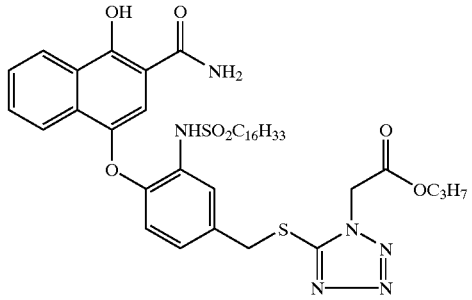

D-5

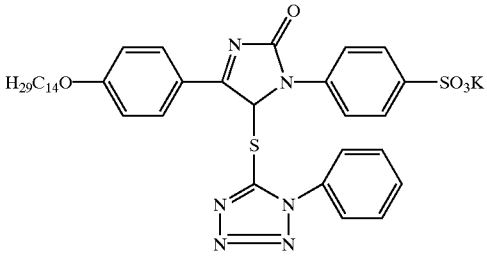

D-6

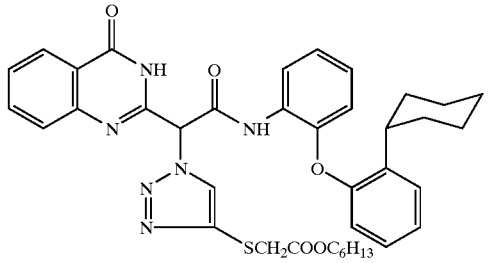

D-7

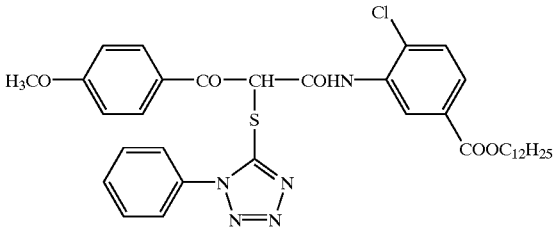

SC-3

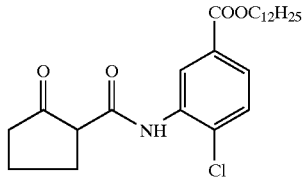

GF-1

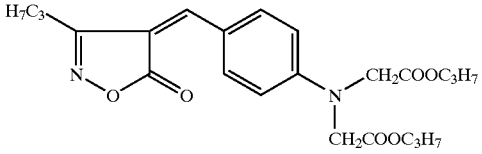

After exposure with a grey wedge, the material is developed in accordance with "The British Journal of Photography", 1974, pages 597 and 598. The developer solution used in processing is that produced from the one-part concentrate according to Examples 15, 17 and 19 and that produced from three separate concentrates according to the prior art.

The resultant colour negatives processed with a developer produced from three separate concentrates according to the prior art and according to Examples 17 and 19 are identical with regard to the sensitometric quality thereof.

What is claimed is:

1. One-part color developer concentrate which contains 50 to 700 mmol/l of at least one color developer substance, at least one antioxidant, at least one water softener, a buffer system, alkali and contains at most 0.1 mol of sulfate ions/L, wherein the concentrate is a multi-phase concentrate and the color developer substance is 4-(N-ethyl-N-2-methylsulfonylaminoethyl)-2-methylphenylenediamine or 4-(N-ethyl-N-2-hydroxyethyl)-2-methylphenylenediamine, said color developer substance essentially being present as free base or as phosphate and the concentrate contains one or more water-soluble organic solvents, 50 to 95 wt. % of the total of water and solvent is water, and the concentrate contains 50 to 700 mmol of color developer substance/L and the concentrate contains two or more liquid phases, but no precipitation.

2. One-part color developer concentrate according to claim 1, wherein the concentrate contains at most 0.05 mol of sulfate ions/L.

3. One-part color developer concentrate according to claim 1, wherein the concentrate contains at most 0.02 mol of sulfate ions/L.

4. One-part color developer concentrate according to claim 1, wherein the organic solvent contains alcohol or an ether.

5. One-part color developer concentrate according to claim 1, wherein the organic solvent is a mixture of polyethylene glycols of differing molecular weights.

6. One-part color developer concentrate according to claim 1, wherein the antioxidant is of one of the formulae (I), (II) or (III):

(I)

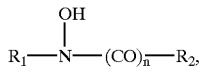

in which $R_1$ is an optionally substituted alkyl, $R_2$ is an optionally substituted alkyl or optionally substituted aryl and n is 0 or 1;

(II)

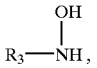

in which $R_3$ is an optionally substituted alkyl or optionally substituted acyl group;

(III)

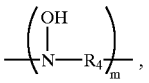

in which $R_4$ is an alkylene group optionally interrupted by O atoms and m is a number of at least 2.

7. One-part color developer concentrate according to claim 4, wherein the alcohol is a mono-, di- or polyalcohol.

8. One-part color developer concentrate according to claim 1, wherein the concentrate, when cooled down to temperatures of down to −7° C., does not form precipitates which are insoluble when the temperature is raised.

9. One-part color developer concentrate which contains 50 to 700 mmol/l of at least one color developer substance, at least one antioxidant, at least one water softener, a buffer system, alkali and contains at most 0.1 mol of sulfate ions/L, wherein the concentrate is a two-phase, concentrate and the color developer substance is 4-(N-ethyl-N-2-methylsulfonylaminoethyl)-2-methylphenylenediamine or 4-(N-ethyl-N-2-hydroxyethyl)-2-methylphenylenediamine, said color developer substance essentially being present as free base or as phosphate and the concentrate contains one or more water-soluble organic solvents, 50 to 95 wt. % of the total of water and solvent is water, and the concentrate contains 50 to 700 mmol of color developer substance/L and the concentrate contains two liquid phases, but no precipitation.

10. One-part color developer concentrate according to claim 9, wherein the concentrate, when cooled down to temperatures of down to −7° C., does not form precipitates which are insoluble when the temperature is raised.

* * * * *

UNITED STATES PATENT AND TRADEMARK OFFICE

CERTIFICATE OF CORRECTION

PATENT NO. : 6,413,703 B1
DATED : July 2, 2002
INVENTOR(S) : Tappe et al.

It is certified that error appears in the above-identified patent and that said Letters Patent is hereby corrected as shown below:

Title page,
Item [75], Inventor's, delete "körner" and insert -- Körner --.

Signed and Sealed this

Twenty-seventh Day of August, 2002

*Attest:*

*Attesting Officer*

JAMES E. ROGAN
*Director of the United States Patent and Trademark Office*